US009306285B2

(12) United States Patent
Huang et al.

(10) Patent No.: US 9,306,285 B2
(45) Date of Patent: Apr. 5, 2016

(54) ANTENNA HAVING THREE OPERATING FREQUENCY BANDS AND METHOD FOR MANUFACTURING THE SAME

(71) Applicant: Arcadyan Technology Corporation, Hsinchu (TW)

(72) Inventors: Chih-Yung Huang, Taichung (TW); Kuo-Chang Lo, Miaoli County (TW); Jen-Hsiang Fang, Hsinchu (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 255 days.

(21) Appl. No.: 14/017,361

(22) Filed: Sep. 4, 2013

(65) Prior Publication Data

US 2014/0062795 A1 Mar. 6, 2014

(30) Foreign Application Priority Data

Sep. 4, 2012 (TW) ..... 101132221 A

(51) Int. Cl.

| | |
|---|---|
| ***H01Q 9/04*** | (2006.01) |
| ***H01Q 1/24*** | (2006.01) |
| ***H01Q 9/40*** | (2006.01) |
| ***H01Q 9/42*** | (2006.01) |
| ***H01Q 5/371*** | (2015.01) |

(52) U.S. Cl.

CPC ..... *H01Q 9/04* (2013.01); *H01Q 1/243* (2013.01); *H01Q 5/371* (2015.01); *H01Q 9/0421* (2013.01); *H01Q 9/40* (2013.01); *H01Q 9/42* (2013.01); *Y10T 29/49016* (2015.01)

(58) Field of Classification Search

CPC ..... H01Q 5/371; H01Q 5/30; H01Q 5/20; H01Q 1/243; H01Q 9/0421

USPC ..... 343/700 MS, 702

See application file for complete search history.

(56) References Cited

U.S. PATENT DOCUMENTS

| | | | | |
|---|---|---|---|---|
| 7,242,352 | B2 | 7/2007 | Tavassoli Hozouri | |
| 7,256,743 | B2 | 8/2007 | Korva | |
| 8,441,399 | B2 * | 5/2013 | Wu | H01Q 1/2258 343/700 MS |
| 2003/0058168 | A1 | 3/2003 | Sadler et al. | |
| 2004/0104853 | A1 * | 6/2004 | Chen | G06F 1/1616 343/702 |
| 2008/0180333 | A1 * | 7/2008 | Martiskainen | H01Q 1/243 343/722 |

(Continued)

FOREIGN PATENT DOCUMENTS

| | | | |
|---|---|---|---|
| JP | 2000-068736 | A | 3/2000 |
| TW | I333715 | B | 12/2008 |

(Continued)

OTHER PUBLICATIONS

Search report issued on Feb. 5, 2014 from European Patent Office in a counterpart European patent.

Office Action was issued on Sep. 2, 2015 from the TW patent Office.

*Primary Examiner* — Dameon E Levi

*Assistant Examiner* — Ab Salam Alkassim, Jr.

(74) *Attorney, Agent, or Firm* — The PL Law Group, PLLC

(57) ABSTRACT

An antenna including a radiation portion is provided. The radiation portion includes a feed terminal and three conductor branch paths directly extending from the feed terminal. The three conductor branch paths are located on the same side of the feed terminal, and each has an initial direction, and any two of the three initial directions have an acute angle therebetween. A method for manufacturing an antenna having three operating frequency bands is also provided.

20 Claims, 4 Drawing Sheets

(56) References Cited

U.S. PATENT DOCUMENTS

| | | | | |
|---|---|---|---|---|
| 2009/0184876 | A1 | 7/2009 | Liu | |
| 2012/0026044 | A1 * | 2/2012 | Lo | H01Q 1/2258 343/700 MS |
| 2012/0050134 | A1 | 3/2012 | Wu et al. | |

FOREIGN PATENT DOCUMENTS

| | | | |
|---|---|---|---|
| TW | I351787 | B | 8/2009 |
| TW | 201119140 | A | 6/2011 |
| TW | 201228118 | A | 7/2012 |
| WO | WO2012/050704 | A1 | 4/2012 |

* cited by examiner

ANTENNA HAVING THREE OPERATING FREQUENCY BANDS AND METHOD FOR MANUFACTURING THE SAME

CROSS-REFERENCE TO RELATED APPLICATION AND CLAIM OF PRIORITY

The application claims the benefit of Taiwan Patent Application No. 101132221, filed on Sep. 4, 2012, at the Taiwan Intellectual Property Office, the disclosures of which are incorporated herein in their entirety by reference.

TECHNICAL FIELD

The present disclosure relates to an antenna structure and, more particularly, relates to an antenna structure having plural operating frequency bands.

BACKGROUND

Nowadays the development of the technology changes with each passing day. Several kinds of lightweight or handy-sized antennas have been developed and applied to the handheld electronic device or the wireless transmission device, which are more handy-sized with each passing day; for instance, the handheld electronic device is a mobile phone or a notebook computer, and the wireless transmission device is an access point, a wireless network card or a wireless card bus. For instance, the existing planar inverted F antenna (PIFA) or the existing monopole antenna has a handy-sized structure and a satisfactory transmission performance, can be easily disposed on the inner wall of the handheld electronic device, and is widely applied in wireless transmission devices of handheld electronic devices, notebook computers or wireless communication devices. In the prior art, the innermost conductor layer and the peripheral conductor layer of the coaxial cable are respectively welded to the signal feed terminal and the signal grounding terminal of the PIFA so as to output the desired transmission signal through the PIFA. In the prior art, a PIFA capable to be applied to a multi-frequency system has properties including a complex structure and uneasy adjustments to the respective frequency bands.

The issued TW patent with No. I351,787 discloses a triple band antenna in the prior art. The issued TW patent with No. I333,715 discloses a miniaturized triple-band diamond coplanar waveguide antenna in the prior art. The issued US patent with U.S. Pat. No. 7,256,743 B2 discloses an internal multi-band antenna in the prior art. The issued US patent with U.S. Pat. No. 7,242,352 B2 discloses a multi-band or wide-band antenna in the prior art.

SUMMARY OF EXEMPLARY EMBODIMENTS

It is an aspect of the present disclosure to provide an antenna structure having three operating frequency bands and a method for manufacturing an antenna having three operating frequency bands.

It is therefore an embodiment of the present disclosure to provide an antenna structure having three operating frequency bands. The antenna structure includes a radiation portion. The radiation portion includes a first conductor branch path, a second conductor branch path and a third conductor branch path. The second conductor branch path is electrically connected to the first conductor branch path. The third conductor branch path includes a first extension portion extending from the second conductor branch path. One of the second and the third conductor branch paths is a longest one of the first, the second and the third conductor branch paths. The longest path includes a shared area covering more than one-third of an area of the longest path. The second branch path overlaps the third conductor branch path in the shared area.

It is therefore another embodiment of the present disclosure to provide a method for manufacturing an antenna having three operating frequency bands. The method includes the following steps. A substrate is provided. A ground portion and a radiation portion having three conductor branch paths are formed on the substrate, wherein one of the three conductor branch paths includes a specific portion having an extension direction. A short-circuit conductor portion is disposed between the ground portion and the radiation portion, wherein the short-circuit conductor portion includes a body having a longitudinal axis, and an extension portion extending from the body in a first inclination direction, and the first inclination direction and the extension direction are located on different sides relative to the longitudinal axis. A relationship between the longitudinal axis and at least one of the first inclination direction and the extension direction is determined so as to cause the antenna to have a predetermined impedance match.

It is therefore still another embodiment of the present disclosure to provide an antenna. The antenna includes a radiation portion. The radiation portion includes a feed terminal and three conductor branch paths directly extending from the feed terminal. The three conductor branch paths are located on the same side of the feed terminal, and each has an initial direction, and any two of the three initial directions have an acute angle therebetween.

BRIEF DESCRIPTION OF THE DRAWINGS

The foregoing and other features and advantages of the present disclosure will be more clearly understood through the following descriptions with reference to the drawings, wherein.

DETAIL DESCRIPTION OF THE PREFERRED EMBODIMENTS

The present disclosure will now be described more specifically with reference to the following embodiments. It is to be noted that the following descriptions of preferred embodiments of this disclosure are presented herein for the purposes of illustration and description only; it is not intended to be exhaustive or to be limited to the precise form disclosed.

Figure 1A:
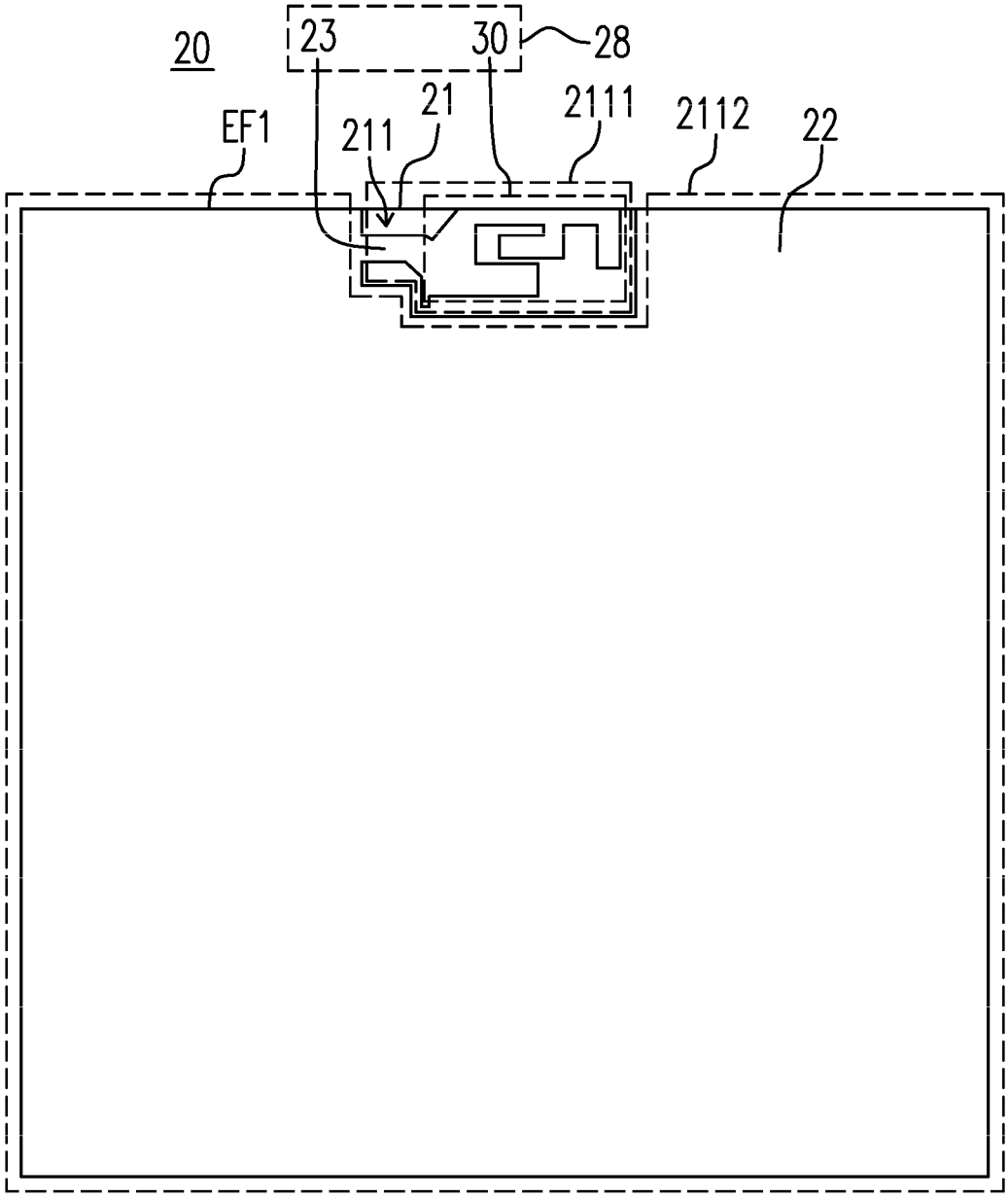
FIG. 1A, FIG. 1B and FIG. 1C are schematic diagrams respectively showing a front view, an equal-angle projection view and a detail front view of an antenna structure according to some embodiments of the present disclosure.
Figure 1B:
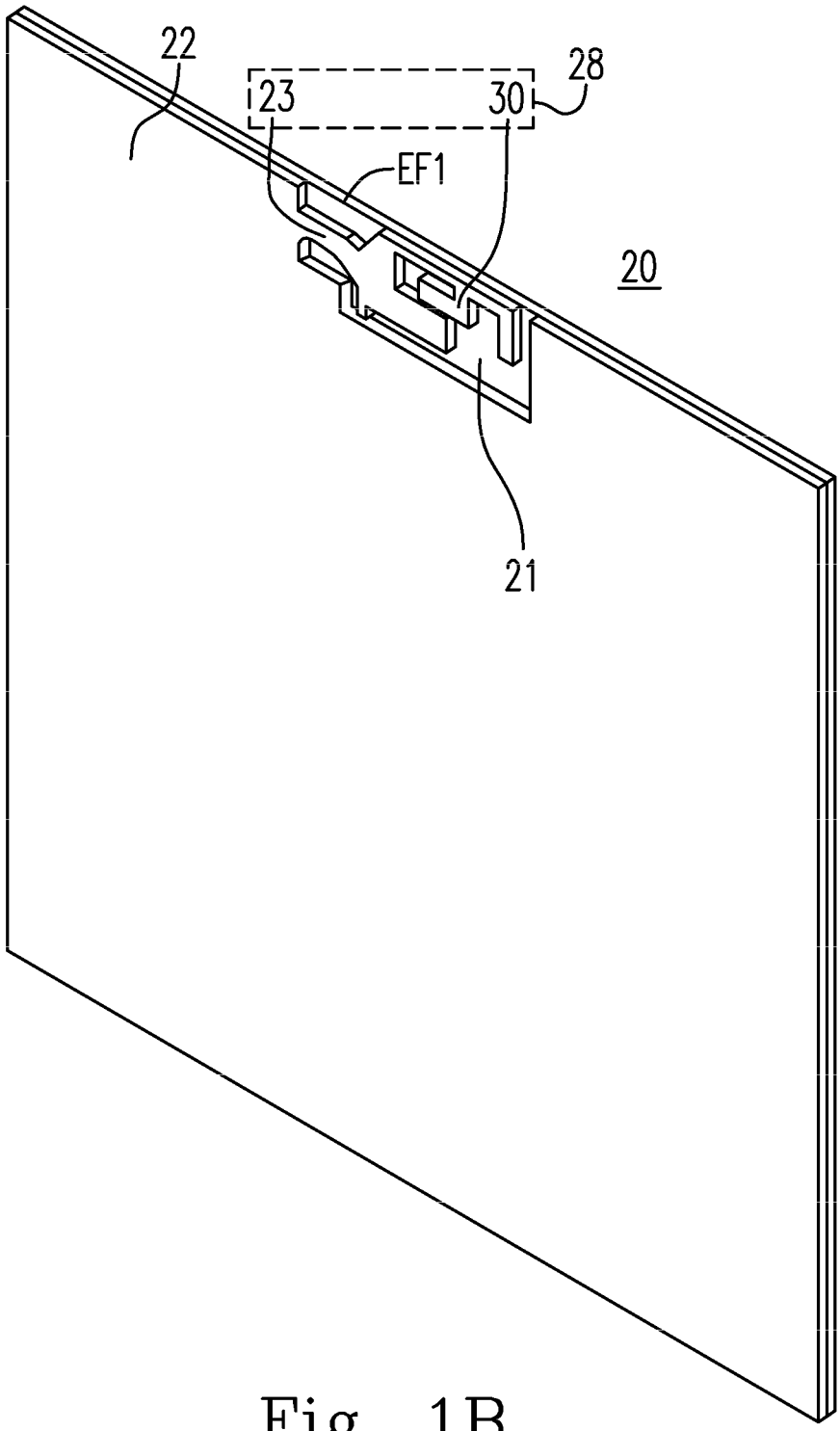
Figure 1C:
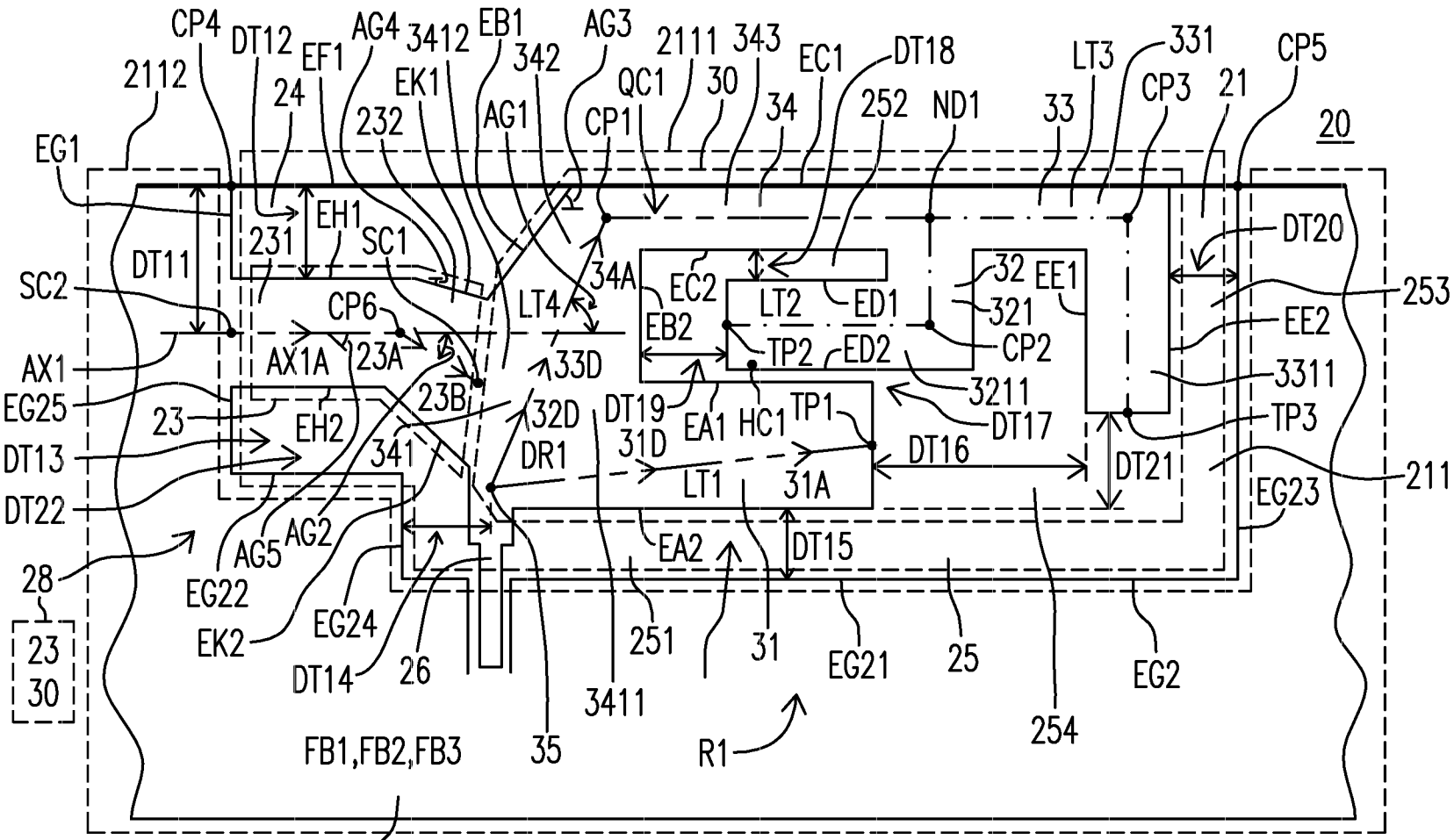

Please refer to FIG. 1A, FIG. 1B and FIG. 1C, which are schematic diagrams respectively showing a front view, an equal-angle projection view and a detail front view of an antenna structure 20 according to some embodiments of the present disclosure. The antenna structure (or an antenna) 20 includes a radiation portion 30. In some embodiments, the radiation portion 30 includes a feed terminal 35 and three conductor branch paths 31, 32 and 33 directly extending from the feed terminal 35. The three conductor branch paths 31, 32 and 33 are located on the same side of the feed terminal 35, and each has an initial direction, and any two of the three initial directions 31D, 32D and 33D have an acute angle DR1 therebetween. For instance, the antenna structure 20 has three operating frequency bands FB1, FB2 and FB3; the three conductor branch paths 31, 32 and 33 respectively have three initial directions 31D, 32D and 33D; and the included angle DR1 between any two of the three initial directions 31D, 32D and 33D is less than 90° . In particular, the acute angle DR1 has an angle value being in a range between 0° and 90° . Especially, the acute angle DR1 has an angle value being in one of the following ranges: between 0° and 80° , or between 0° and 70° , or between 0° and 55° , or between 0° and 60° , or in particular between 0° and 65° .

In some embodiments, the conductor branch path 31 directly extending from the feed terminal 35 to a terminal position TP1, and has a length LT1, an extension direction 31A from the feed terminal 35 to the terminal position TP1, an edge EA1 and edge EA2 opposite to the edge EA1. The conductor branch path 32 is electrically connected to the conductor branch path 31, and includes a length LT2. The conductor branch path 33 has a length LT3. One of the conductor branch paths 32 and 33 is a longest path (such as the conductor branch path 33) of the conductor branch paths 31, 32 and 33. The longest path (such as the conductor branch path 33) includes a shared area QC1 covering more than one-third of an area of the longest path. The conductor branch paths 32 and 33 share the shared area QC1; that is, the conductor branch path 32 overlaps the conductor branch path 33 in the shared area QC1.

In some embodiments, a shared conductor branch path 34 includes a part of the conductor branch path 32 and a part of the conductor branch path 33, occupies the shared area QC1, and has a length LT4. For instance, the length LT4 is greater than one-third of the length LT3. In some embodiments, the shared area QC1 covers more than half of the longest path; and the extension direction 31A is close to or aligned with the initial direction 31D. For instance, the length LT4 is greater than half of the length LT3. For instance, the conductor branch path 32 and the conductor branch path 33 share the shared conductor branch path 34. For instance, the part of the conductor branch path 32 and the part of the conductor branch path 33 overlap to form the shared conductor branch path 34.

In some embodiments, the shared conductor branch path 34 directly extends from the feed terminal 35 to a node ND1, and further has an initial extension portion 341, a corner position CP1, an extension direction 34A from the feed terminal 35 to the corner position CP1, a sub-path 342 between the initial extension portion 341 and the corner position CP1, and a sub-path 343 between the corner position CP1 and the node ND1. The initial extension portion 341 includes a side 3411 relative to the feed terminal 35 and a side 3412 opposite to the side 3411, wherein the side 3411 is coupled to the conductor branch path 31, and the side 3412 includes a short-circuiting terminal SC1.

In some embodiments, the extension direction 34A is close to or aligned with each of the initial directions 32D and 33D. The sub-path 342 includes an edge EB1 and an edge EB2 opposite to the edge EB1. The sub-path 343 includes an edge EC1 and an edge EC2 opposite to the edge EC1. For instance, the extension directions 31A and 34A includes an acute angle therebetween; and the shared area QC1 extends from the short-circuiting terminal SC1, the feed terminal 35 and the conductor branch path 31. In some embodiments, the initial direction 32D is aligned with the initial direction 33D; and the initial directions 31D and 32D have a specific included angle therebetween having an angle value being in a range between 30° and 90°. Especially, the specific included angle has an angle value being in one of the following ranges: between 45° and 75°, or between 50° and 70°, or in particular between 55° and 65°.

In some embodiments, the conductor branch path 32 includes the shared conductor branch path 34 and an extension portion 321 extending from the node ND1 to a terminal position TP2. The extension portion 321 includes a corner position CP2, and a sub-path 3211 between the corner position CP2 and the terminal position TP2. The sub-path 3211 includes an edge ED1 and an edge ED2 opposite to the edge ED1. For instance, the extension portion 321 forms an included angle, close to or being a right angle, at the corner position CP2 by making a turn. The conductor branch path 33 includes the shared conductor branch path 34 and an extension portion 331 extending from the node ND1 to a terminal position TP3. The extension portion 331 includes a corner position CP3, and a sub-path 3311 between the corner position CP3 and the terminal position TP3. The sub-path 3311 includes an edge EE1 and an edge EE2 opposite to the edge EE1. For instance, the extension portion 331 forms an included angle, close to or being a right angle, at the corner position CP3 by making a turn.

In some embodiments, the antenna structure 20 further includes a substrate 21, a ground portion 22, a short-circuit conductor portion 23, a gap structure 24, a gap structure 25 and a feed connection portion 26. The substrate 21 includes a surface 211, wherein the surface 211 includes an edge EF1, a side portion 2111 adjacent to the edge EF1, and a body portion 2112 partially surrounding the side portion 2111, and the radiation portion 30 is disposed on the side portion 2111. For instance, the substrate 21 is a dielectric substrate. The feed connection portion 26 is electrically connected between the feed terminal 35 and a module terminal (not shown), and has a specific impedance. For instance, the module terminal is an antenna port, and the specific impedance is equal to 50Ω or 75Ω. For instance, the feed connection portion 26 is a cable.

In some embodiments, the ground portion 22 is disposed on the body portion 2112, and includes a corner position CP4 adjacent to the edge EF1 of the substrate 21, a corner position CP5 adjacent to the edge EF1 of the substrate 21, a short-circuiting terminal SC2 at a distance DT11 from the corner position CP4, an edge EG1 partially surrounding the radiation portion 30 and located between the corner position CP4 and the short-circuiting terminal SC2, and an edge EG2 partially surrounding the radiation portion 30 and located between the corner position CP5 and the short-circuiting terminal SC2, wherein the corner position CP4 is opposite to the corner position CP4 in respect to the radiation portion 30.

In some embodiments, on the side portion 2111, the short-circuit conductor portion 23 extends from the short-circuiting terminal SC2 to the short-circuiting terminal SC1, and includes a corner position CP6, a body 231 between the short-circuiting terminal SC2 and the corner position CP6, an extension portion 232 between the corner position CP6 and the short-circuiting terminal SC1, and an extension direction 23A from the corner position CP6 to the short-circuiting terminal SC1. The body 231 of the short-circuit conductor portion 23 includes an edge EH1, an edge EH2 opposite to the edge EH1, and a longitudinal axis AX1 with a longitudinal axis direction AX1A, wherein the longitudinal axis AX1 passes through the short-circuiting terminal SC2. The extension portion 232 includes an edge EK1, an edge EK2 opposite to the edge EK1. For instance, the extension direction 23A is an inclination direction 23B; the short-circuit conductor portion 23 forms an obtuse angle at the corner position CP6 by making a turn; the longitudinal axis AX1 is parallel or nearly parallel to the edge EA2; and the longitudinal axis AX1 is perpendicular or nearly perpendicular to the edge EB2. For instance, the longitudinal axis AX1 is parallel or nearly parallel to the edge EC1; and the edges EB1 and EC1 have an obtuse angle therebetween.

In some embodiments, the gap structure 24 is disposed among the edge EG1 of the ground portion 22, the short-circuit conductor portion 23 and the shared conductor branch path 34. The gap structure 25 is disposed among the short-circuit conductor portion 23, the radiation portion 30 and the edge EG2 of the ground portion 22. For instance, the gap structures 24 and 25 are interconnected. In some embodiments, the gap structure 24 is disposed among the edge EG1 of the ground portion 22, the short-circuit conductor portion 23 and the sub-path 342. In some embodiments, the radiation portion 30, the ground portion 22 and the short-circuit conductor portion 23 is coplanar. The edge EG2 of the ground portion 22 includes a sub-edge EG21 having a bottom height, a sub-edge EG22 having a middle height, a sub-edge EG23 between the corner position CP5 and the sub-edge EG21, a sub-edge EG24 between the sub-edge EG21 and the sub-edge EG22, and a sub-edge EG25 between the short-circuiting terminal SC2 and the sub-edge EG22. For instance, a distance between the sub-edge EG21 and the edge EF1 is longer than a distance between the sub-edge EG22 and the edge EF1.

In some embodiments, the gap structure 25 includes four gaps 251, 252, 253 and 254. The gap 251 is disposed among the short-circuit conductor portion 23, the conductor branch path 31, the sub-edge EG21, the sub-edge EG24, the sub-edge EG22 and the sub-edge EG25. The gap 252 is disposed between the conductor branch paths 31 and 32. The gap 253 is disposed between the sub-path 3311 and the sub-edge EG23. The gap 254 is disposed between the extension portion 331 and the sub-edge EG21.

In some embodiments, the edge EH1 of the body 231 and the edge EF1 of the substrate 21 have a distance DT12 therebetween. The edge EH2 of the body 231 and the sub-edge EG22 have a distance DT13 therebetween. The feed terminal 35 and the sub-edge EG24 have a distance DT14 therebetween. The edge EA2 of the conductor branch path 31 and the sub-edge EG21 have a distance DT15 therebetween. The terminal position TP1 and the edge EE1 of the sub-path 3311 have a distance DT16 therebetween. The edge EA1 of the conductor branch path 31 and the edge ED2 of the sub-path 3211 have a distance DT17 therebetween. The edge ED1 of the sub-path 3211 and the edge EC2 of the sub-path 343 have a distance DT18 therebetween. The terminal position TP2 and the edge EB2 of the sub-path 342 have a distance DT19 therebetween. The edge EE2 of the sub-path 3311 and the sub-edge EG23 have a distance DT20 therebetween. The terminal position TP3 and the edge EA2 of the conductor branch path 31 have a distance DT21 therebetween. The feed terminal 35 and the longitudinal axis AX1 have a distance DT22 therebetween. For instance, the distances DT12, DT13, DT14, DT15, DT16, DT17, DT18, DT19, DT20, DT21 and DT22 are eleven perpendicular distances.

In some embodiments, the longitudinal axis direction AX1A and the extension direction 34A have an included angle AG1 therebetween. The longitudinal axis direction AX1A and the extension direction 23A have an included angle AG2 therebetween. For instance, the included angles AG1 and AG2 are two acute angles, respectively. The antenna structure 20 uses the conductor branch paths 31, 32 and 33 to respectively form operating frequency bands FB1, FB2 and FB3. The distance DT16 is changeable to cause the operating frequency band FB1 to be movable. The distance DT19 is changeable to cause the operating frequency band FB2 to be movable. The distance DT21 is changeable to cause the operating frequency band FB3 to be movable. For instance, the distance DT21 is changed to cause the operating frequency band FB3 to move from a first specific frequency band to a second specific frequency band. For instance, the distance DT19 is changed to cause the operating frequency band FB2 to move from a third specific frequency band to a fourth specific frequency band. For instance, the distance DT16 is changed to cause the operating frequency band FB1 to move from a fifth specific frequency band to a sixth specific frequency band.

In some embodiments, the operating frequency bands FB1, FB2 and FB3 are determined by the conductor branch paths 31, 32 and 33 respectively. The operating frequency band FB1 changes with the distance DT16. The operating frequency band FB2 changes with the distance DT19. The operating frequency band FB3 changes with the distance DT21. The antenna structure 20 makes a predetermined impedance match in response to a change of one being selected from a group consisting of the distances DT12, DT13, DT14, DT15, DT17, DT18, DT20 and DT22, the included angles AG1 and AG2 and a combination thereof.

In some embodiments, the antenna structure 20 includes a wire structure 28, which includes the radiation portion 30 and the short-circuit conductor portion 23. At least one selected from a group consisting of the distances DT12, DT13, DT14, DT15, DT17, DT18, DT20 and DT22, and the included angles AG1 and AG2 is changeable to cause the antenna structure 20 to have a predetermined impedance match. For instance, the wire structure 28 has an impedance R1; and at least one selected from a group consisting of the distances DT12, DT13, DT14, DT15, DT17, DT18, DT20 and DT22, and the included angles AG1 and AG2 is changeable to change the impedance R1, thereby causing the antenna structure 20 to have the predetermined impedance match. For instance, the predetermined impedance match is associated with the impedance R1 and the feed connection portion 26.

In some embodiments, the longitudinal axis direction AX1A and the edge EB1 have an included angle AG3 (denoted through a translation) therebetween; the longitudinal axis direction AX1A and the edge EK1 have an included angle AG4 (denoted through a translation) therebetween; and the longitudinal axis direction AX1A and the edge EK2 have an included angle AG5 therebetween. For instance, a ratio of the included angle AG1 to the included angle AG2 has a value being in a range between 1.0 and 3.0; and especially, the ratio has a value being in one of the following ranges: between 1.5 and 2.5, or in particular between 1.8 and 2.2. For instance, the included angle AG2 has an angle value being in a range between 5° and 61°. Especially, the included angle AG2 has an angle value being in one of the following ranges: between 15° and 51°, or between 24° and 42°, or between 28° and 39°, or in particular between 30° and 36°. At least one selected from a group consisting of the distances DT12, DT13, DT14, DT15, DT17, DT18, DT20 and DT22, and the included angles AG1, AG2, AG3, AG4 and AG5 is changeable to cause the antenna structure 20 to have a predetermined impedance match. For instance, at least one selected from a group consisting of the distances DT12, DT13, DT14, DT15, DT17, DT18, DT20 and DT22, and the included angles AG1, AG2, AG3, AG4 and AG5 is changed to change the impedance R1, thereby causing the antenna structure 20 to have the predetermined impedance match. In some embodiments, the antenna structure 20 makes a predetermined impedance match in response to a change of one being selected from a group consisting of the distances DT12, DT13, DT14, DT15, DT17, DT18, DT20 and DT22, the included angles AG1, AG2, AG3, AG4 and AG5 and a combination thereof.

In some embodiments provided according to the illustrations in FIGS. 1A, 1B and 1C, an antenna structure 20 having three operating frequency bands FB1, FB2 and FB3 includes a radiation portion 30, which includes conductor branch paths 31, 32 and 33. The conductor branch path 32 is electrically connected to the conductor branch path 31; and the conductor branch path 33 includes an extension portion 331 extending from the conductor branch path 32. One of the conductor branch paths 32 and 33 is a longest one (such as the conductor branch path 33) of the conductor branch paths 31, 32 and 33. The longest path (such as the conductor branch path 33) includes a shared area QC1 covering more than one-third of an area of the longest path; and the conductor branch path 32 overlaps the conductor branch path 33 in the shared area QC1.

In some embodiments provided according to the illustrations in FIGS. 1A, 1B and 1C, a method for manufacturing an antenna structure (or an antenna) 20 having three operating frequency bands FB1, FB2 and FB3 includes the following steps. A substrate 21 is provided. A ground portion 22 and a radiation portion 30 having three conductor branch paths 31, 32 and 33 are formed on the substrate 21, wherein one of the three conductor branch paths 31, 32 and 33 includes a specific portion (including the initial extension portion 341 and the sub-path 342, for example) having an extension direction 34A. A short-circuit conductor portion 23 is disposed between the ground portion 22 and the radiation portion 30, wherein the short-circuit conductor portion 23 includes a body 231 having a longitudinal axis AX1, and an extension portion 232 extending from the body 231 in an inclination direction 23B, and the inclination direction 23B and the extension direction 34A are located on different sides relative to the longitudinal axis AX1. A relationship between the longitudinal axis AX1 and at least one of the inclination direction 23B and the extension direction 34A is determined so as to cause the antenna structure 20 to have a predetermined impedance match.

In some embodiments, the radiation portion 30 further has a feed terminal 35 and a centroid HC1. The conductor branch path 31 directly extends from the feed terminal 35 to a terminal position TP1, and includes an outer edge (such as the edge EA2) relative to the centroid HC1. A shared conductor branch path 34 includes a part of the conductor branch path 32 and a part of the conductor branch path 33, directly extends from the feed terminal 35 to a node ND1, and includes an initial extension portion 341, a corner position CP1 and a sub-path 342 between the initial extension portion 341 and the corner position CP1. The sub-path 342 includes a first inner edge (such as the edge EB2) relative to the centroid HC1.

In some embodiments, the conductor branch path 32 includes the shared conductor branch path 34 and an extension portion 321 extending from the node ND1 to a terminal position TP2, wherein the extension portion 321 includes a corner position CP2.

The conductor branch path 33 includes the shared conductor branch path 34 and an extension portion 331 extending from the node ND1 to a terminal position TP3. The part of the conductor branch path 32 and the part of the conductor branch path 33 overlap to form the shared conductor branch path 34. The extension portion 331 includes a corner position CP3 and a sub-path 3311 between the corner position CP3 and the terminal position TP3, wherein the sub-path 3311 includes a second inner edge (such as the edge EE1) relative to the centroid HC1. The terminal position TP1 and the second inner edge (such as the edge EE1) have a first perpendicular distance (such as the distance DT16) therebetween. The terminal position TP2 and the first inner edge (such as the edge EB2) have a second perpendicular distance (such as the distance DT19) therebetween. The terminal position TP3 and the outer edge (such as the edge EA2) have a third perpendicular distance (such as the distance DT21) therebetween.

In some embodiments, the method for manufacturing the antenna structure 20 further includes the following steps. The conductor branch paths 31, 32 and 33 are used to respectively form the operating frequency bands FB1, FB2 and FB3. The first operating frequency band FB1 is obtained by adjusting the first perpendicular distance (such as the distance DT16). The second operating frequency band FB2 is obtained by adjusting the second perpendicular distance (such as the distance DT19). The third operating frequency band FB3 is obtained by adjusting the third perpendicular distance (such as the distance DT21).

In some embodiments provided according to the illustrations in FIGS. 1A, 1B and 1C, the antenna structure 20 is a printed antenna structure, and is used in a wireless transmission device (not shown). In some embodiments, the antenna structure 20 is used on a printed circuit board, has a geometrical structure to be adjusted easily, and can be applied to a specific device (such as a wireless communication device), which has a system frequency band demand for the operating frequency bands LTE-Band 20 (790~870 MHz), LTE-Band 3 (1770~1880 MHz) and LTE-Band 7 (2500~2700 MHz). For instance, the wireless communication device is a notebook computer, a mobile phone, an access point, or a device of a television or a digital video disk, which includes the Wi-Fi technique. For instance, the antenna structure 20 may be applied to the LTE (Long Term Evolution) system employing Band 20, Band 3 and Band 7. For instance, the bands of the antenna structure 20 may be slightly adjusted to cause the antenna structure 20 to be applied to another wireless communication system employing three operating frequency bands.

In some embodiments, it is easy for the antenna structure 20 to be adjusted for the required frequency bands in different environments. For instance, the antenna structure 20 includes a conductive structure (including the radiation portion 30, the ground portion 22 and the short-circuit conductor portion 23), which is directly printed on a substrate 21 (such as a circuit board), thereby being able to reduce the mold cost and the production assembly cost relative to the three-dimensional antenna and being applied to wireless network devices in various environments.

In some embodiments, the antenna structure 20 is a PIFA antenna structure, and includes the substrate 21, the ground portion 22 and a wire structure 28. For instance, the wire structure 28 is a microstrip line, is printed on the side portion 2111, and includes the feed terminal 35 and the short-circuiting terminal SC2. The feed terminal 35 serves as a signal feed-in terminal, and the short-circuiting terminal SC2 serves as a signal grounding terminal. The substrate 21 further includes a reverse side opposite to the surface 211. The reverse side has a first surface portion and a second surface portion. The first surface portion corresponds to the side portion 2111, and is not printed with a ground metal surface. The second surface portion corresponds to the wire structure 28, and may be printed with a ground metal surface (under a three-laminate board condition) or may be completely no metal (under a two-laminate board condition). For instance, the antenna structure 20 is built in a wireless transmission device.

In some embodiments, the radiation portion 30 includes conductor branch paths 31, 32 and 33 directly extending from the feed terminal 35. The conductor branch paths 31, 32 and 33 respectively have lengths LT1, LT2 and LT3 for forming resonances, and are respectively used to form the operating frequency bands FB1, FB2 and FB3, which are designed at desire. The operating frequency bands FB1, FB2 and FB3 respectively have a first operating frequency, a second operating frequency and a third operating frequency, which respectively have a first resonance wavelength, a second resonance wavelength and a third resonance wavelength. A quarter of the first resonance wavelength, a quarter of the second resonance wavelength and a quarter of the third resonance wavelength are a first length, a second length and a third length; and the lengths LT1, LT2 and LT3 are about equal to the first, the second and the third lengths, so that the radiation portion 30 can be used to radiate the frequency-band signals.

In some embodiments, the short-circuit conductor portion 23 extends from the short-circuiting terminal SC1 of the radiation portion 30 to the short-circuiting terminal SC2. For instance, the short-circuiting terminal SC2 corresponds to a signal grounding terminal of a PIFA antenna structure, and is connected to the ground system of the whole system. The short-circuit conductor portion 23 may simultaneously adjust the impedance match of the antenna structure 20 in order that the VSWR of the antenna structure 20 can reach the specification and the requirement of the industry. In some embodiments, the operating frequency bands FB1, FB2 and FB3 respectively have independent adjustment mechanisms (such as the distances DT16, DT19 and DT21). In this way, the independent adjustment mechanisms can be conveniently independently easily used to adjust the operating points of the respective operating frequency bands so as to reach the systematic application.

In some embodiments, the feed connection portion 26 is electrically connected between the feed terminal 35 and a module terminal, and is a cable having an impedance of son. A terminal of the cable may be directly bonded with the feed terminal 35 to feed an antenna signal, and another terminal of the cable may be arbitrarily extended. In some embodiments, the length LT1 of the conductor branch path 31 is adjustable to cause the operating frequency of the operating frequency band FB1 to be adjustable; the length of the sub-path 3211 is adjustable to cause the operating frequency of the operating frequency band FB2 to be adjustable; and the length of the sub-path 3311 is adjustable to cause the operating frequency of the operating frequency band FB2 to be adjustable. For instance, the short-circuiting terminal SC2 corresponds to a signal grounding terminal of a PIFA antenna structure, and is connected to the ground system of the whole system. For instance, the ground portion 22 serves as a ground terminal of the whole system. For instance, the substrate 21 is a dielectric layer of a printed circuit board.

Figure 2:
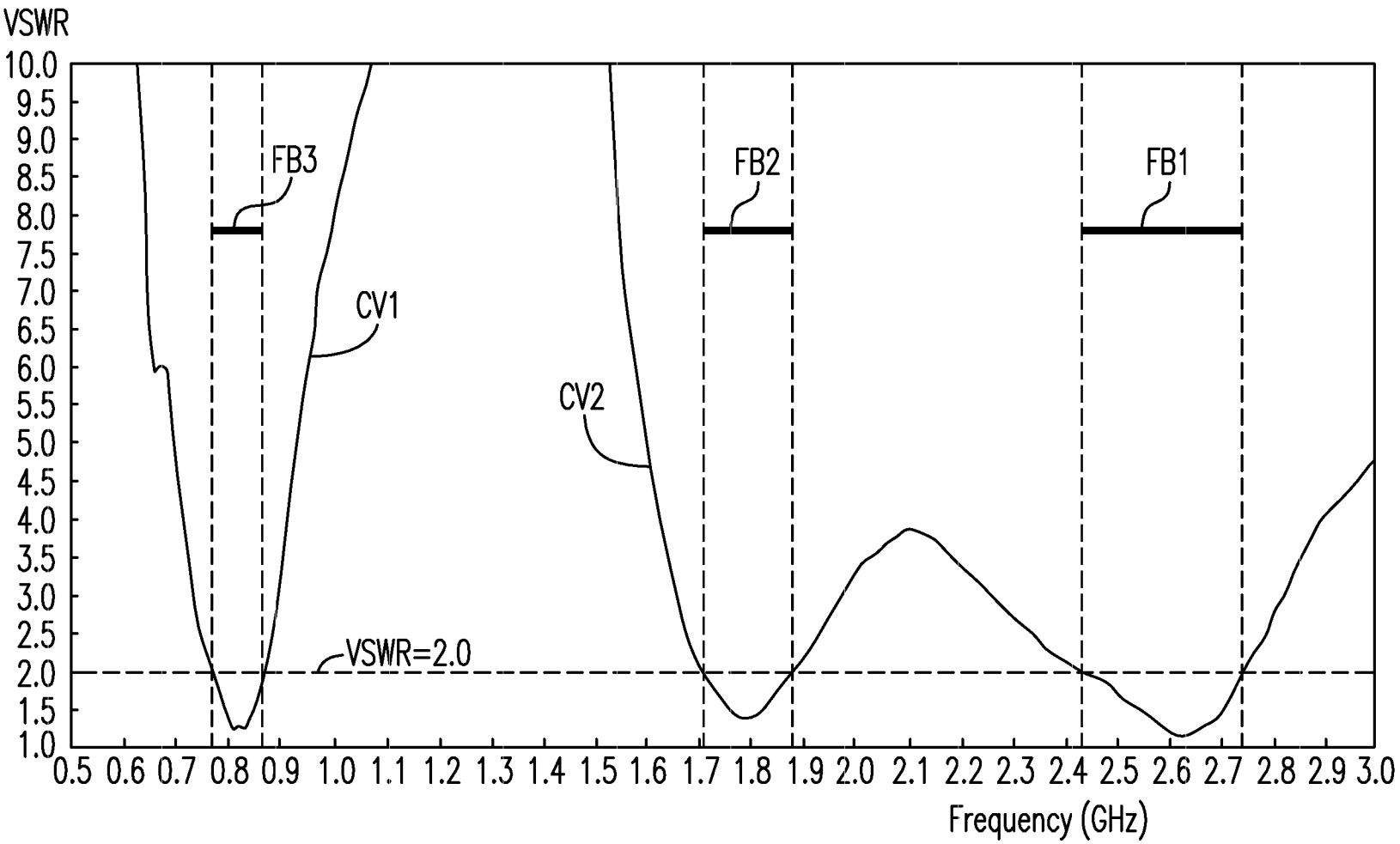
FIG. 2 is a test result graph showing a voltage standing wave ratio (VSWR) of the antenna structure in FIGS. 1A, 1B and 1C.

Please refer to FIG. 2, which is a test result graph showing a voltage standing wave ratio (VSWR) of the antenna structure 20 in FIGS. 1A, 1B and 1C. FIG. 2 shows the relation curves CV1 and CV2 between the frequency and the VSWR of the antenna structure 20, the frequency band FB3 obtained from the relation curve CV1, and the frequency bands FB2 and FB1 obtained from the relation curve CV2. As shown in FIG. 2, in the frequency band FB3 having a frequency ranged from 0.775 GHz to 0.875 GHz, the VSWR drops below the desirable maximum value of 2, and the frequency band FB3 indicates a bandwidth of 100 MHz. In the frequency band FB2 having a frequency ranged from 1.70 GHz to 1.90 GHz, the VSWR drops below the desirable maximum value of 2, and the frequency band FB2 indicates a bandwidth of 200 MHz. In the frequency band FB1 having a frequency ranged from 2.40 GHz to 2.75 GHz, the VSWR drops below the desirable maximum value of 2, and the frequency band FB1 indicates a bandwidth of 350 MHz. The mentioned bandwidths fully cover the bandwidths of wireless communications under LTE band standards.

While the disclosure has been described in terms of what is presently considered to be the most practical and preferred embodiments, it is to be understood that the disclosure needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. An antenna structure having three operating frequency bands, comprising:

a radiation portion comprising:

a feed terminal;

a first conductor branch path;

a second conductor branch path electrically connected to the first conductor branch path;

a third conductor branch path including a first extension portion extending from the second conductor branch path, wherein:

one of the second and the third conductor branch paths is a longest one of the first, the second and the third conductor branch paths;

the longest path includes a shared area covering more than one-third of an area of the longest path;

each of the first, the second and the third conductor branch paths extends from the feed terminal;

the first, the second and the third conductor branch paths are located on the same side of the feed terminal, and respectively have three initial directions;

any two of the three initial directions have an acute angle therebetween;

a shared conductor branch path is both a part of the second conductor branch path and a part of the third conductor branch path, has a first corner position and a first sub-path between the feed terminal and the first corner position, and directly extends from the feed terminal to a node through the first sub-path and the first corner position;

the part of the second conductor branch path and the part of the third conductor branch path share the shared area;

the second conductor branch path includes a second extension portion including a second corner position, and extending from the node to a first terminal position through the second corner position;

the first terminal position is disposed between the second corner position and the first sub-path;

the first extension portion includes a third corner position, and extends from the node to a second terminal position through the third corner position; and the first terminal position is disposed between the second terminal position and the first sub-path.

2. An antenna structure according to claim 1, wherein:

the shared conductor branch path occupies the shared area;

the first conductor branch path directly extends from the feed terminal to a third terminal position, and includes a first edge and a second edge opposite to the first edge;

the shared conductor branch path further includes an initial extension portion, a first extension direction from the feed terminal to the first corner position, and a second sub-path between the first corner position and the node; and the first sub-path is disposed between the initial extension portion and the first corner position.

3. An antenna structure according to claim 2, wherein:

the initial extension portion includes a first side relative to the feed terminal and a second side opposite to the first side, wherein the first side is coupled to the first conductor branch path, and the second side includes a first short-circuiting terminal;

the first sub-path includes a first edge and a second edge opposite to the first edge of the first sub-path;

the second sub-path includes a first edge and a second edge opposite to the first edge of the second sub-path;

the second extension portion further includes a third sub-path between the second corner position and the first terminal position;

the third sub-path includes a first edge and a second edge opposite to the first edge of the third sub-path;

the first extension portion further includes a fourth sub-path between the third corner position and the second terminal position; and the fourth sub-path includes a first edge and a second edge opposite to the first edge of the fourth sub-path.

4. An antenna structure according to claim 3, further comprising:

a substrate including a first surface, wherein the first surface includes a first edge, a side portion adjacent to the first edge of the substrate, and a body portion partially surrounding the side portion, and the radiation portion is disposed on the side portion;

a ground portion disposed on the body portion, and including a fourth corner position adjacent to the first edge of the substrate, a fifth corner position adjacent to the first edge of the substrate, a second short-circuiting terminal at a first distance from the fourth corner position, a first edge partially surrounding the radiation portion and located between the fourth corner position and the second short-circuiting terminal, and a second edge partially surrounding the radiation portion and located between the fifth corner position and the second short-circuiting terminal;

a short-circuit conductor portion extending from the second short-circuiting terminal to the first short-circuiting terminal on the side portion, and including a sixth corner position, a body between the second short-circuiting terminal and the sixth corner position, and a second extension direction from the sixth corner position to the first short-circuiting terminal, wherein the body of the short-circuit conductor portion includes a first edge, a second edge opposite to the first edge of the body, and a longitudinal axis with a longitudinal axis direction, and the longitudinal axis passes through the second short-circuiting terminal;

a feed connection portion electrically connected to the feed terminal;

a first gap structure disposed among the first edge of the ground portion, the short-circuit conductor portion and the shared conductor branch path; and a second gap structure disposed among the short-circuit conductor portion, the radiation portion and the second edge of the ground portion.

5. An antenna structure according to claim 4, wherein:

the radiation portion, the ground portion and the short-circuit conductor portion are coplanar; and the second edge of the ground portion includes a first sub-edge having a bottom height, a second sub-edge having a middle height, a third sub-edge between the fifth corner position and the first sub-edge, a fourth sub-edge between the first sub-edge and the second sub-edge, and a fifth sub-edge between the second short-circuiting terminal and the second sub-edge.

6. An antenna structure according to claim 5, wherein:

the second gap structure includes a first gap, a second gap, a third gap and a fourth gap;

the first gap of the second gap structure is disposed among the short-circuit conductor portion, the first conductor branch path, the first sub-edge, the fourth sub-edge, the second sub-edge and the fifth sub-edge;

the second gap of the second gap structure is disposed between the first and the second conductor branch paths;

the third gap is disposed between the fourth sub-path and the third sub-edge; and the fourth gap is disposed between the second extension portion and the first sub-edge.

7. An antenna structure according to claim 5, wherein:

the first edge of the body of the short-circuit conductor portion and the first edge of the substrate have a second distance therebetween;

the second edge of the body of the short-circuit conductor portion and the second sub-edge have a third distance therebetween;

the feed terminal and the fourth sub-edge have a fourth distance therebetween;

the second edge of the first conductor branch path and the first sub-edge have a fifth distance therebetween;

the third terminal position and the first edge of the fourth sub-path have a sixth distance therebetween;

the edge of the first conductor branch path and the second edge of the third sub-path have a seventh distance therebetween;

the first edge of the third sub-path and the second edge of the second sub-path have an eighth distance therebetween;

the first terminal position and the second edge of the first sub-path have a ninth distance therebetween;

the second edge of the fourth sub-path and the third sub-edge have a tenth distance therebetween;

the second terminal position and the second edge of the first conductor branch path have an eleventh distance therebetween;

the feed terminal and the longitudinal axis have a twelfth distance therebetween;

the longitudinal axis direction and the first extension direction have a first included angle therebetween;

the longitudinal axis direction and the second extension direction have a second included angle therebetween; and the three operating frequency bands are a first operating frequency band, a second operating frequency band and a third operating frequency band.

8. An antenna structure according to claim 7, wherein:

the first, the second and the third operating frequency bands are determined by the first, the second and the third conductor branch paths respectively;

the first operating frequency band changes with the sixth distance;

the second operating frequency band changes with the ninth distance;

the third operating frequency band changes with the eleventh distance; and the antenna structure makes an impedance match in response to a change of at least one being selected from a group consisting of the second, the third, the fourth, the fifth, the seventh, the eighth, the tenth and the twelfth distances and the first and the second included angles.

9. A method for manufacturing an antenna having three operating frequency bands, comprising steps of:

providing a substrate;

on the substrate, forming a ground portion and a radiation portion having three conductor branch paths, wherein one of the three conductor branch paths includes a specific portion having an extension direction;

disposing a short-circuit conductor portion between the ground portion and the radiation portion, wherein the short-circuit conductor portion includes a body having a longitudinal axis, and an extension portion extending from the body in a first inclination direction, and the first inclination direction and the extension direction are located on different sides relative to the longitudinal axis; and determining a relationship between the longitudinal axis and at least one of the first inclination direction and the extension direction so as to cause the antenna to have a predetermined impedance match, wherein:

the radiation portion further has a feed terminal;

the three conductor branch paths extend from the feed terminal, are a first conductor branch path, a second conductor branch path and a third conductor branch path, are located on the same side of the feed terminal, and respectively have three initial directions;

any two of the three initial directions have an acute angle therebetween;

a shared conductor branch path has a first corner position and a first sub-path between the feed terminal and the first corner position, and directly extends from the feed terminal to a node through the first sub-path and the first corner position;

the second conductor branch path includes a first extension portion including a second corner position, and extending from the node to a first terminal position through the second corner position;

the first terminal position is disposed between the second corner position and the first sub-path;

the third conductor branch path includes a second extension portion including a third corner position, and extending from the node to a second terminal position through the third corner position; and the first terminal position is disposed between the second terminal position and the first sub-path.

10. A method according to claim 9, wherein:

the radiation portion further has a centroid;

the first conductor branch path directly extends from the feed terminal to a third terminal position, and includes an outer edge relative to the centroid;

the shared conductor branch path is both a part of the second conductor branch path and a part of the third conductor branch path, further has an initial extension portion; and the first sub-path is disposed between the initial extension portion and the first corner position.

11. A method according to claim 10, wherein:

the first sub-path includes a first inner edge relative to the centroid;

the part of the second conductor branch path and the part of the third conductor branch path overlap to form the shared conductor branch path;

the second extension portion further includes a second sub-path between the third corner position and the third terminal position;

the second sub-path includes a second inner edge relative to the centroid;

the third terminal position and the second inner edge have a first perpendicular distance therebetween;

the first terminal position and the first inner edge have a second perpendicular distance therebetween;

the second terminal position and the outer edge have a third perpendicular distance therebetween; and the three operating frequency bands are a first operating frequency band, a second operating frequency band and a third operating frequency band.

12. A method according to claim 11, further comprising steps of:

using the first, the second and the third conductor branch paths to respectively form the first, the second and the third operating frequency bands;

obtaining the first operating frequency band by adjusting the first perpendicular distance;

obtaining the second operating frequency band by adjusting the second perpendicular distance; and obtaining the third operating frequency band by adjusting the third perpendicular distance.

13. An antenna, comprising:

a radiation portion comprising a feed terminal and three conductor branch paths extending from the feed terminal, wherein:

the three conductor branch paths are located on the same side of the feed terminal, and respectively have three initial directions;

any two of the three initial directions have an acute angle therebetween;

the three conductor branch paths are a first conductor branch path, a second conductor branch path and a third conductor branch path;

a shared conductor branch path has a first corner position and a first sub-path between the feed terminal and the first corner position, and directly extends from the feed terminal to a node through the first sub-path and the first corner position;

the second conductor branch path includes a first extension portion including a second corner position, and extending from the node to a first terminal position through the second corner position;

the first terminal position is disposed between the second corner position and the first sub-path;

the third conductor branch path includes a second extension portion including a third corner position, and extending from the node to a second terminal position through the third corner position; and the first terminal position is disposed between the second terminal position and the first sub-path.

14. An antenna according to claim 13, wherein:

the first conductor branch path directly extends from the feed terminal to a third terminal position, and includes a first edge and a second edge opposite to the first edge of the first conductor branch path;

the second conductor branch path is electrically connected to the first conductor branch path;

one of the second and the third conductor branch paths is a longest path of the three conductor branch paths;

the longest path includes a shared area covering more than one-third of an area of the longest path;

the shared conductor branch path is both a part of the second conductor branch path and a part of the third conductor branch path, occupies the shared area, and further has an initial extension portion, a first extension direction from the feed terminal to the first corner position, and a second sub-path between the first corner position and the node the part of the second conductor branch path and the part of the third conductor branch path share the shared area; and the first sub-path is disposed between the initial extension portion and the first corner position.

15. An antenna according to claim 14, wherein:

the initial extension portion includes a first side relative to the feed terminal and a second side opposite to the first side, wherein the first side is coupled to the first conductor branch path, and the second side includes a first short-circuiting terminal;

the first sub-path includes a first edge and a second edge opposite to the first edge of the first sub-path;

the second sub-path includes a first edge and a second edge opposite to the first edge of the second sub-path;

the first extension portion further includes a third sub-path between the second corner position and the first terminal position;

the third sub-path includes a first edge and a second edge opposite to the first edge of the third sub-path;

the part of the second conductor branch path and the part of the third conductor branch path overlap to form the shared conductor branch path;

the second extension portion further includes a fourth sub-path between the third corner position and the second terminal position; and the fourth sub-path includes a first edge and a second edge opposite to the first edge of the fourth sub-path.

16. An antenna according to claim 15, further comprising:

a substrate including a first surface, wherein the first surface includes a first edge, a side portion adjacent to the first edge of the substrate and a body portion partially surrounding the side portion, and the radiation portion is disposed on the side portion;

a ground portion disposed on the body portion, and including a fourth corner position adjacent to the first edge of the substrate, a fifth corner position adjacent to the first edge of the substrate, a second short-circuiting terminal at a first distance from the fourth corner position, a first edge partially surrounding the radiation portion and located between the fourth corner position and the second short-circuiting terminal, and a second edge partially surrounding the radiation portion and located between the fifth corner position and the second short-circuiting terminal;

a short-circuit conductor portion extending from the second short-circuiting terminal to the first short-circuiting terminal on the side portion, and including a sixth corner position, a body between the second short-circuiting terminal and the sixth corner position, and a second extension direction from the sixth corner position to the first short-circuiting terminal, wherein the body of the short-circuit conductor portion includes a first edge, a second edge opposite to the first edge of the body, and a longitudinal axis with a longitudinal axis direction, and the longitudinal axis passes through the second short-circuiting terminal;

a feed connection portion electrically connected to the feed terminal;

a first gap structure disposed among the first edge of the ground portion, the short-circuit conductor portion and the shared conductor branch path; and a second gap structure disposed among the short-circuit conductor portion, the radiation portion and the second edge of the ground portion.

17. An antenna according to claim 16, wherein:

the radiation portion, the ground portion and the short-circuit conductor portion are coplanar; and the second edge of the ground portion includes a first sub-edge having a bottom height, a second sub-edge having a middle height, a third sub-edge between the fifth corner position and the first sub-edge, a fourth sub-edge between the first sub-edge and the second sub-edge, and a fifth sub-edge between the second short-circuiting terminal and the second sub-edge.

18. An antenna according to claim 17, wherein:

the second gap structure includes a first gap, a second gap, a third gap and a fourth gap;

the first gap of the second gap structure is disposed among the short-circuit conductor portion, the first conductor branch path, the first sub-edge, the fourth sub-edge, the second sub-edge and the fifth sub-edge;

the second gap of the second gap structure is disposed between the first and the second conductor branch paths;

the third gap is disposed between the fourth sub-path and the third sub-edge; and the fourth gap is disposed between the second extension portion and the first sub-edge.

19. An antenna according to claim 17, wherein:

the first edge of the body of the short-circuit conductor portion and the first edge of the substrate have a second distance therebetween;

the second edge of the body of the short-circuit conductor portion and the second sub-edge have a third distance therebetween;

the feed terminal and the fourth sub-edge have a fourth distance therebetween;

the second edge of the first conductor branch path and the first sub-edge have a fifth distance therebetween;

the third terminal position and the first edge of the fourth sub-path have a sixth distance therebetween;

the first edge of the first conductor branch path and the second edge of the third sub-path have a seventh distance therebetween;

the first edge of the third sub-path and the second edge of the second sub-path have an eighth distance therebetween;

the first terminal position and the second edge of the first sub-path have a ninth distance therebetween;

the second edge of the fourth sub-path and the third sub-edge have a tenth distance therebetween;

the second terminal position and the second edge of the first conductor branch path have an eleventh distance therebetween;

the feed terminal and the longitudinal axis have a twelfth distance therebetween;

the longitudinal axis direction and the first extension direction have a first included angle therebetween;

the longitudinal axis direction and the second extension direction have a second included angle therebetween; and the antenna has three operating frequency bands being a first operating frequency band, a second operating frequency band and a third operating frequency band.

20. An antenna according to claim 19, wherein:

the first, the second and the third operating frequency bands are determined by the first, the second and the third conductor branch paths respectively;

the first operating frequency band changes with the sixth distance;

the second operating frequency band changes with the ninth distance;

the third operating frequency band changes with the eleventh distance; and the antenna makes a predetermined impedance match in response to a change of one being selected from a group consisting of the second, the third, the fourth, the fifth, the seventh, the eighth, the tenth and the twelfth distances, the second and the third included angles and a combination thereof.

* * * * *